United States Patent [19]

Richards et al.

[11] Patent Number: 4,903,446

[45] Date of Patent: Feb. 27, 1990

[54] PRESTRESSED PLASTIC FOAM STRUCTURAL MEMBER

[75] Inventors: Jack Richards; Marilyn Richards, both of Palatka, Fla.

[73] Assignee: Wesley Staples, Palatka, Fla.

[21] Appl. No.: 186,434

[22] Filed: Apr. 26, 1988

[51] Int. Cl.[4] ..... E04B 1/14; E04C 2/22

[52] U.S. Cl. ..... 52/223 R; 52/309.7

[58] Field of Search ..... 52/309.7, 309.16, 630, 52/223 R, 733, 739

[56] References Cited

U.S. PATENT DOCUMENTS

| | | | |
|---|---|---|---|
| 2,311,613 | 2/1943 | Slayter | 52/309.16 |
| 2,477,407 | 7/1949 | Grant et al. | 52/309.16 |
| 2,836,529 | 5/1958 | Morris | 52/309.16 |
| 3,115,727 | 12/1963 | Middendorf | 52/733 |
| 3,150,032 | 9/1964 | Rubenstein | 52/223 R |
| 3,561,175 | 3/1969 | Best et al. | 52/169 |
| 3,727,441 | 4/1973 | Kelly | 72/6 |
| 3,766,699 | 10/1973 | Dinkel | 52/309.7 |
| 3,789,556 | 2/1974 | Skinner | 52/93 |
| 3,802,134 | 4/1974 | McCorvey | 52/93 |
| 3,810,337 | 5/1974 | Pollard | 52/309.7 |
| 3,905,167 | 9/1975 | Watkins et al. | 52/79 |
| 3,960,999 | 6/1976 | Massie | 52/309.7 |
| 3,986,311 | 10/1976 | Muhe et al. | 52/733 |
| 4,029,037 | 6/1977 | Hogan | 52/309.7 |
| 4,031,285 | 6/1977 | Miller et al. | 52/309.7 |
| 4,128,975 | 12/1978 | Abate | 52/125 |
| 4,187,651 | 2/1980 | Tolsma | 52/79 |
| 4,216,634 | 8/1980 | Binder | 52/309 |
| 4,281,492 | 8/1981 | Schock et al. | 52/309.9 |
| 4,295,309 | 10/1981 | Hornbeck | 52/309 |
| 4,486,993 | 12/1984 | Graham et al. | 52/262 |
| 4,558,550 | 12/1985 | Marchais et al. | 52/309.7 |
| 4,578,909 | 4/1986 | Henley et al. | 52/90 |

FOREIGN PATENT DOCUMENTS

| | | | |
|---|---|---|---|
| 2629373 | 1/1978 | Fed. Rep. of Germany | 52/309.7 |

*Primary Examiner*—Carl D. Friedman
*Assistant Examiner*—Caroline D. Dennison
*Attorney, Agent, or Firm*—Kerkam, Stowell, Kondracki & Clarke

[57] ABSTRACT

A lightweight structural member made of prestressed plastic foam is provided, the prestress provided by a plurality of tendons disposed within the foam to which tensile forces are applied during mold casting of the structural member, the tendons being retained in tension by bonding between the tendons and the foam, or by way of anchors which are spaced along the tendons to retain the tendons in immobile condition, one or more skin layers also being optionally provided. A method for producing a lightweight structural member of prestressed plastic foam is also provided.

19 Claims, 1 Drawing Sheet

FIG. 1
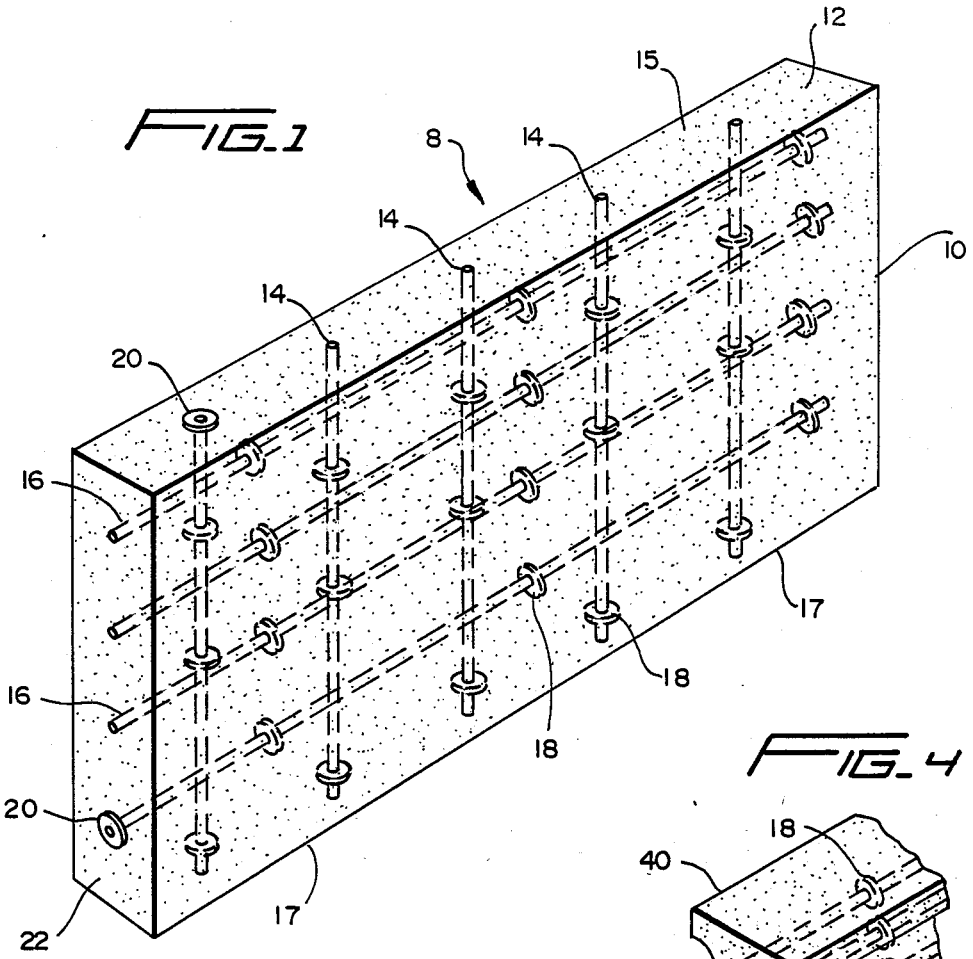
FIG. 4
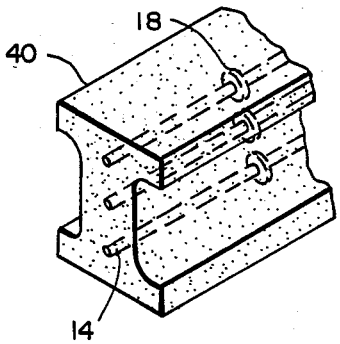
FIG. 2
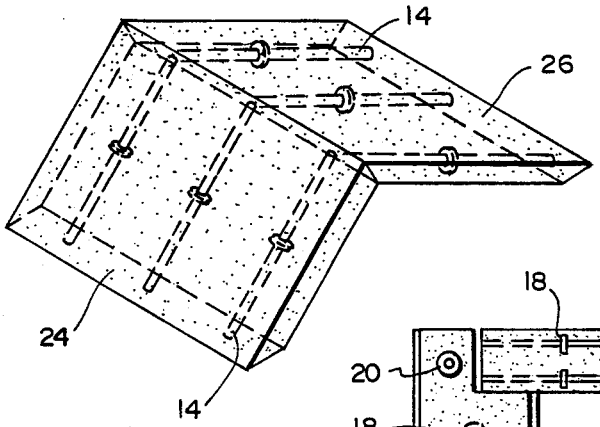
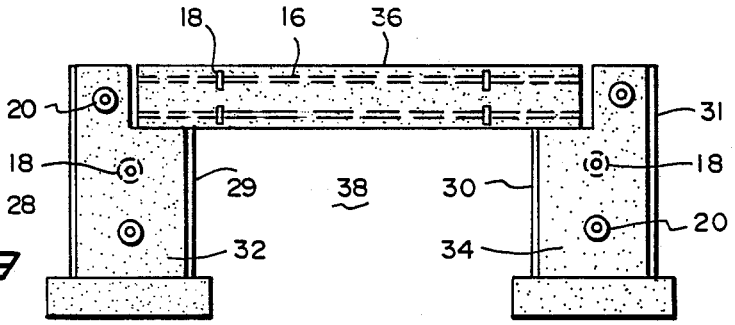
FIG. 3

PRESTRESSED PLASTIC FOAM STRUCTURAL MEMBER

BACKGROUND OF THE INVENTION

1. Field of the Invention

The present invention is directed to load-bearing structural members of a prestressed plastic foam material.

2. Description of Related Art

Heretofore, polymer foam materials, have been used in the building construction industry, primarily as insulation materials. The low density and low weight of plastic foam combine to make it a desirable insulation material, whether in panel form (expanded) or loose bead form (expandable).

Foam panels have been used, for example, to provide an insulative layer between walls separated by studwork or other framework. Loose plastic foam can be "blown" into voids, cavities, or other empty spaces to fill or partially fill such cavities, thereby improving the insulative characteristics of the structure. Plastic foams also possess good resistance to water vapor transmission in these and other applications.

Plastic foams are also known to possess relatively good structural strength, provided the material is fairly thick, although they have been primarily employed in load bearing applications only in combination with more widely recognized structural materials. An example of this is a use in a sandwich panel where the plastic is employed as an insulative core material. The light weight of foam panels, however, would make it a very desirable material of construction provided sufficient strength could be achieved in thicknesses comparable to other standard construction materials for which it could be used as a substitute.

Useful foam plastics are polyethylene foams, polypropylene foams, structural ABS foams, rigid polyurethane foams, polystyrene foams and phenolic foams. Of these polyurethane foams are preferred.

Prestressing, through various techniques, has previously been used in connection with concrete structural members as an approach to improving the relatively poor tensile strength of concrete. Concrete building materials, while exhibiting high strengths, are also quite heavy and cumbersome to build with, usually requiring heavy equipment for movement and placement of elements. In certain construction applictions, particularly residential home building, use of such heavy members and heavy equipment is undesirable, and in some instances not feasible.

It is therefore a primary object of the present invention to provide a lightweight plastic foam structural member having improved physical properties for use in load-bearing applications.

It is a further object of the present invention to provide a prestressed plastic foam structural member for use in various building and construction applications.

It is a further object of the present invention to provide a plastic foam structural member having one or more prestressed flexible lines or cords traversing the interior of the member to improve the strength characteristics of the structural member.

It is a further object of the present invention to provide a prestressed plastic foam structural member having one or more protective skin layers.

It is yet a further object of the present invention to provide a method for fabricating a lightweight plastic foam structural member having improved strength characteristics.

SUMMARY OF THE INVENTION

The above and other objects of the present invention are accomplished by providing a prestressed plastic foam structural member and a method of making a structural member of this type. Structural members according to the present invention are fabricated by casting a plastic foamable material in a mold in which one or more lines or cords, referred to hereinafter collectively as tendons, are retained in a pre-stressed state of tension. Structural members according to the present invention may be produced in various finished shapes and sizes through the use of molds having these various shapes.

Structural members according to the present invention will appear, when viewed from the exterior, to resemble commonly recognizable plastic foam. The structural members according to the present invention are, however, fabricated with a plurality of tendons which have been molded in place in the member in a prestressed or pre-tensioned condition.

Once the molding steps are completed in producing the structural member, the tendons which are held in tension during the molding process impart resultant compressive forces within the member due to the interaction of the member with the tendons. These compressive forces increase the load-bearing properties of the member.

The method for making a prestressed foam structural member according to the present invention involves disposing one or more tendons, preferably of a flexible and porous material, in appropriate predetermined locations within the mold, applying a tensile force to the lines or cords, casting the foam in the mold according to known molding processes, and releasing the applied tensile force when molding is completed.

It is also contemplated continuous forming with the tendons maintained under tension.

The lightweight plastic foam structural member produced by the method of the present invention has sufficiently high strength to be used in many load-bearing applications. A significant advantage provided by the structural members of the present invention is that the light weight of the members greatly facilitates handling and fitting of the members in building and other types of construction.

BRIEF DESCRIPTION OF THE DRAWINGS

These and other features of the present invention and the attendant advantages will be readily apparent to those having ordinary skill in the art, and the invention will be more easily understood from the following detailed description of the preferred embodiments of the present invention taken in conjunction with the accompanying drawings wherein like reference characters represent like parts throughout the several views, and wherein:

FIG. 1 is a perspective view of a prestressed plastic foam panel having parallel, planar, front and rear surfaces;

FIG. 2 is a perspective view of two members made of prestressed plastic foam configured to form a pitched roof section;

FIG. 3 is a side view of a combination of foundation members and a floor member made of prestressed plastic foam according to the present invention; and FIG. 4 is a partial perspective of a prestressed plastic foam beam member according to the present invention.

DETAILED DESCRIPTION OF THE PREFERRED EMBODIMENTS

Referring initially to FIG. 1, a structural member 8 is depicted as a panel in accordance with a preferred embodiment of the invention, the panel being identified by the numeral 10. Panel 10 comprises a polyurethane foam element 12, and has a plurality of vertical and/or horizontal lines or cords, hereinafter referred to generally as tendons 14, 16 traversing the interior of the panel. Tendons 14, for example, may also be described as extending from one external surface 15 of the plastic foam element 12 to another external surface 17 of the element.

The material selected for tendons 14, 16 preferably meets three criteria. The tendons 14, 16 are preferably porous, such that bonding with the plastic foam is facilitated, should possess high strength, and should be low in cost. Examples of the types of materials contemplated for use are sisal rope, cotton twine and other types of rope such as a non-stretching poly rope.

Tendons 14, 16 may be optionally provided with anchors 18, attached to and spaced along the length of the tendons to provide resistance to movement within the foam panel. The use of anchors 18, shown in the Figures as resembling metal washers, also allows substantially non-porous materials to be used as tendons 14, 16, such as wire or steel cable. Barbed wire of the commonly available type can be employed in this type of application. Other types of anchors, in addition to steel washers or barbs, include steel plates and coils. The anchors 18, serve as a restraining means by resisting movement of the tendons and rendering them substantially immobile, and also assist in the transfer of prestress from the tendons to the foam panel. The panel 10 may also be provided with end anchors 20 fastened to the tendons at the edges 22 of the panel, the end anchors 20 assisting in maintaining the tendons under tension.

Panel 10 is provided with a prestress by fabricating the panel according to the method of the present invention. A mold (not shown) is first selected, having an interior contour suitable for yielding a desired finished shape of a plastic foam structural member 8. If desired, the interior of the mold can be of a configuration other than the desired finished shape, and the structural member 8 may subsequently be cut, for example, to the desired finished shape. Prior to charging or casting the foamable material in the mold, a plurality of tendons 14, 16 are disposed in the mold cavity and a predetermined tensile force is applied to the tendons 14, 16 producing tensile stresses in the tendons, and also producing small amounts of elongation, or strain, in the tendons. The foamable material, say in pellet form, is then charged or cast in the mold using conventional procedures for filling, heating, and subsequent cooling. At least a portion of the cooling will preferably take place outside the mold, to expedite the fabrication process.

Following this described method, a prestressed foam structural member is produced. The tendons, 14, 16 if made of one of the porous materials previously identified, will be bonded to the surrounding foam by virtue of their porosity and the adhesive characteristics of the foam itself. This can be termed a self-adhesion bond, which provides the member with a means for retaining the tendons in tension and also in a substantially immobile condition. In a structural member having tendons 14, 16 made of steel wire, cable or other substantially non-porous material, anchors 18 fastened to and carried by the tendons will provide a suitable substitute for the "bonding" between the foam and porous tendons. Both types of tendons transfer the stresses induced by tensile or pulling force to the structural member once the member is completely fabricated.

A basic panel such as panel 10 in FIG. 1, according to the present invention, has been tested to determine the panel's resistance to deflection and a rupture failure strength. The panel tested possessed the following dimensions: 4 feet in width, 8 feet in length, and 3¼ inches thick. Panel 10 was supported in a flat position by two beams spaced 7 feet apart. A load was then applied in the form of concrete blocks, loosely stacked and distributed substantially uniformly across the panel. The test load was increased incrementally to a load corresponding to 155 pounds per square foot, a load which the panel supported for approximately 80 minutes. The corresponding deflection at this load was 1.6 inches.

Design loads for residential structures of low or medium height are approximately 40–60 lb/ft$^2$ for structural floors (occupancy or live loading) and approximately 20–35 lb/ft$^2$ for lateral loads in wall members. Even when considering that a design safety factor of 2 is customarily used for floors, meaning the actual anticipated design loads are multiplied by 2, it is clear that the structural members of the present invention can be used in many applications.

As can be seen in FIG. 2, structural members according to the present invention can be manufactured in sizes and shapes making them suitable for use as roofing members 24, 26. The light weight of these members 24, 26 compared to other conventional roofing materials makes them much easier to handle during a construction project. Also, the insulative capabilities of the plastic foam are an especially important advantage when used in constructing roofs.

In this and other applications, it may be desirable to provide the prestressed plastic foam members 24, 26, with skin layers 28, 29, 30, 31 (FIG. 3) to protect the panel against the environment. Examples of types of skin layers contemplated for use with these structural members are metal foils, sheet metal skins, and skins made of glass fiber screen material, all of which are capable of being bonded to the foam material.

Other examples of uses for prestressed foamed structural members according to the present invention are shown in FIGS. 3 and 4. FIG. 3 is a side view of two foundation/footer elements 32, 34, which rest on a lower flat surface and support a floor element 36 spanning the distance between them. All of these elements 32, 34, 36, as shown, are fabricated as prestressed polyurethane members. Footings 32, 34 may be disposed at a subterranean level, where they will provide some measure of insulation for the space 38 underneath the floor from cold emitted from the ground beside elements 32, 34. Again, in this application it may be desirable to provide the elements with skins 28, 30 to reduce moisture seepage into the elements.

FIG. 4 shows an end portion of a beam 40 fabricated of prestressed foam. Depicted as resembling an I-beam, various shapes can be produced depending on the desired end use and design. These beams 40 are intended to be used in much the same type of applications where steel or concrete beams are currently used today.

Numerous other shapes not shown in the Figures may also be produced for use as prestressed foam structural members. Semi-circular elements, having a predetermined radius of curvature and segment length, may be used to to construct a cylindrically shaped structure for use as a storage tank for solids or liquids.

Several variations on the above-described structural members are contemplated, including various schemes or layouts for the positioning of the tendons 14, 16. For example, instead of providing only horizontal and vertical tendons 14, 16 (FIG. 1), panel 10 could also be provided with diagonally crossing tendons (not shown), either in conjunction with, or in place of, the tendons 14, 16 shown. Such layouts may largely be dictated by the engineering requirements for the end use of the structural member.

Another readily envisioned variation is that the amount of tension applied to the tendons in the prestress process could be varied both within the same member and also from member-to-member. Again, engineering considerations such as the size of the member to be produced will likely dictate such variations.

It will be evident to those skilled in the art that various modifications may be made in the structural member without departing from the spirit and the scope of the present invention as defined in the appended claims.

What is claimed is:

1. A prestressed structural member comprising:

a polymer foam element having an exterior surface; and at least one tendon disposed within said polymer foam element at a predetermined location, said tendon extending substantially entirely through said foam element from a first predetermined external surface of said foam element to a second predetermined external surface, means for retaining said tendon in tension and in substantially immobile condition within said foam element, wherein said tendon possesses residual stresses thereby inducing a prestress in said structural member, said retaining means comprising a plurality of anchors fastened to and protruding from an exterior surface of said tendon, said plurality of anchors being disposed on a portion of said tendon within said polymer foam element.

2. A prestressed structural member as defined in claim 1 wherein said polymer foam element is a polyurethane foam element.

3. A prestressed structural member as defined in claim 2, further comprising a plurality of tendons disposed at predetermined locations and extending substantially through said member from one external surface of said element to another external surface, each of said plurality of tendons having at least one anchor protruding from an exterior surface thereof within said polymer foam element.

4. A prestressed structural member as defined in claim 3 wherein a first group of said tendons is disposed to extend across a width of said member and a second group of tendons is disposed to extend across a length of said member.

5. A prestressed structural member as defined in claim 2 wherein said tendon is made of a porous material.

6. A prestressed structural member as defined in claim 1 wherein said tendon is made of steel wire.

7. A prestressed structural member as defined in claim 6 wherein said plurality of anchors fastened to said tendon comprise metal washers.

8. A prestressed structural member as defined in claim 1 further comprising a first skin layer, said first skin layer being attached to and substantially covering at least a first exterior face of said structural member.

9. A prestressed structural member as defined in claim 8 further comprising a second exterior face disposed in a plane parallel to a plane containing said first exterior face, said second exterior face having a second skin layer said second skin layer being attached to and substantially covering said second exterior face.

10. A prestressed structural member as defined in claim 9 wherein at least one of said first and said second skin layers is made of metal foil.

11. A prestressed structural member as defined in claim 9 wherein at least one of said first and said second skin layers is made of a glass fiber screen material.

12. A prestressed structural member comprising:

a polymer foam element having an exterior surface;

a first and a second group of tendons, said first group of tendons being spaced apart and being disposed to extend across a width of said structural member, said second group of tendons being spaced apart and being disposed to extend across a length of said structural member, said tendons being made of strands of a porous material;

means for retaining said tendons in tension and in a substantially immobile condition within said foam element, wherein said tendons possess residual stresses thereby inducing a prestress in said structural member;

wherein said retaining means comprises a self-adhesion bond between said tendons and said plastic foam; and at least a first skin layer, said first skin layer covering substantially a first exterior face of said structural member.

13. A prestressed structural member as recited in claim 12 wherein said tendons are made of a cotton twine material.

14. A prestressed structural member as recited in claim 12 wherein said tendons are made of a sisal rope material.

15. A prestressed structural member as recited in claim 12 comprising a second skin layer, said second skin layer covering substantially a second exterior face of said structural member opposite said first exterior face.

16. A prestressed structural member as recited in claim 15 wherein at least one of said first and said second skin layers is made of metal foil.

17. A prestressed structural member as recited in claim 15 wherein at least one of said first and said second skin layers is made of a glass fiber screen material.

18. A prestressed structural member comprising:

a polymer foam element having an exterior surface;

at least one tendon disposed within said polymer foam element at a predetermined location, said tendon extending substantially entirely through said foam element from a first predetermined external surface to a second predetermined external surface, means for retaining said tendon in tension and in a substantially immobile condition within said foam element, wherein said tendon possesses residual stresses thereby inducing a prestress in said structural member; and wherein said tendon is made of a porous material, and said retaining means comprises a self-adhesion bond between said tendon and said polymer foam element.

19. A prestressed structural member as recited in claim 18 wherein said retaining means further comprises a plurality of anchors fastened to and protruding from an exterior surface of said tendon, said plurality of anchors being disposed on said tendon within said polymer foam element.

* * * * *